US011959676B2

(12) United States Patent
Prins et al.

(10) Patent No.: US 11,959,676 B2
(45) Date of Patent: Apr. 16, 2024

(54) METHOD FOR CONTROLLING A VAPOUR COMPRESSION SYSTEM AT A REDUCED SUCTION PRESSURE

(71) Applicant: Danfoss A/S, Nordborg (DK)

(72) Inventors: Jan Prins, Nordborg (DK); Lars Finn Sloth Larsen, Nordborg (DK)

(73) Assignee: Danfoss A/S, Nordborg (DK)

( * ) Notice: Subject to any disclaimer, the term of this patent is extended or adjusted under 35 U.S.C. 154(b) by 501 days.

(21) Appl. No.: 17/278,738

(22) PCT Filed: Sep. 12, 2019

(86) PCT No.: PCT/EP2019/074352
§ 371 (c)(1),
(2) Date: Mar. 23, 2021

(87) PCT Pub. No.: WO2020/064351
PCT Pub. Date: Apr. 2, 2020

(65) Prior Publication Data

US 2022/0034567 A1 Feb. 3, 2022

(30) Foreign Application Priority Data

Sep. 25, 2018 (EP) ..... 18196411

(51) Int. Cl.
*F25B 49/02* (2006.01)

(52) U.S. Cl.
CPC ..... *F25B 49/02* (2013.01); *F25B 2400/075* (2013.01); *F25B 2400/13* (2013.01);
(Continued)

(58) Field of Classification Search
CPC ..... F25B 49/02; F25B 2400/075; F25B 2400/13; F25B 2600/025;
(Continued)

(56) References Cited

U.S. PATENT DOCUMENTS 4,227,862 A 10/1980 Andrew et al.
7,389,648 B2 6/2008 Concha et al.
(Continued)

FOREIGN PATENT DOCUMENTS

CA 2855733 A1 5/2013
CN 1926391 A 3/2007
(Continued)

OTHER PUBLICATIONS

International Search Report for PCT Serial No. PCT/EP2019/074352 dated Nov. 27, 2019.
(Continued)

*Primary Examiner* — Kun Kai Ma
(74) *Attorney, Agent, or Firm* — McCormick, Paulding & Huber PLLC

(57) ABSTRACT

A method for controlling a vapour compression system (1) including a compressor unit (2) including one or more compressors (3, 12), a heat rejecting heat exchanger (4), a receiver (6), an expansion device (7) and an evaporator (8) arranged in a refrigerant path. A pressure value indicating a pressure prevailing inside the receiver (6) is obtained, and the obtained pressure value is compared to a first threshold pressure value. In the case that the obtained pressure value is below the first threshold pressure value, the compressor(s) (3, 12) of the compressor unit (2) are controlled in order to reduce a suction pressure of the vapour compression system (1).

18 Claims, 5 Drawing Sheets

(52) U.S. Cl.
CPC . *F25B 2600/025* (2013.01); *F25B 2600/0272* (2013.01); *F25B 2600/2523* (2013.01)

(58) Field of Classification Search
CPC ..... F25B 2600/0272; F25B 2600/2523; F25B 2400/16; F25B 2400/23; F25B 2500/19
See application file for complete search history.

(56) References Cited

U.S. PATENT DOCUMENTS

| | | | |
|---|---|---|---|
| 7,891,201 | B1 | 2/2011 | Bush et al. |
| 10,208,985 | B2 | 2/2019 | Najafifard |
| 10,496,108 | B2 | 12/2019 | Zha et al. |
| 2001/0037653 | A1 | 11/2001 | Yamanaka et al. |
| 2003/0182961 | A1 | 10/2003 | Nishida et al. |
| 2004/0237550 | A1 | 12/2004 | Yamasaki et al. |
| 2004/0237553 | A1 | 12/2004 | Yamasaki et al. |
| 2004/0244407 | A1 | 12/2004 | Yamasaki et al. |
| 2005/0126194 | A1 | 6/2005 | Ebara et al. |
| 2005/0193753 | A1 | 9/2005 | Concha et al. |
| 2006/0277932 | A1 | 12/2006 | Otake et al. |
| 2007/0271936 | A1 | 11/2007 | Wakamoto et al. |
| 2010/0115975 | A1 | 5/2010 | Mitra et al. |
| 2010/0132399 | A1 | 6/2010 | Mitra et al. |
| 2010/0175400 | A1 | 7/2010 | Kasahara |
| 2011/0036110 | A1 | 2/2011 | Fujimoto et al. |
| 2011/0138835 | A1 | 6/2011 | Takayama et al. |
| 2011/0154839 | A1 | 6/2011 | Mihara et al. |
| 2011/0154840 | A1 | 6/2011 | Mihara et al. |
| 2011/0162397 | A1 | 7/2011 | Huff et al. |
| 2011/0314846 | A1 | 12/2011 | Heinbokel et al. |
| 2012/0117988 | A1 | 5/2012 | Mitra et al. |
| 2012/0227427 | A1 | 9/2012 | Liu et al. |
| 2012/0318008 | A1 | 12/2012 | Liu et al. |
| 2013/0000340 | A1 | 1/2013 | Takayama et al. |
| 2013/0298593 | A1 | 11/2013 | Christensen |
| 2013/0319036 | A1 | 12/2013 | Taras et al. |
| 2014/0151015 | A1 | 6/2014 | Sun et al. |
| 2014/0157811 | A1 | 6/2014 | Shimazu et al. |
| 2014/0208785 | A1 | 7/2014 | Wallace et al. |
| 2014/0245767 | A1 | 9/2014 | Miyakoshi et al. |
| 2014/0326018 | A1 | 11/2014 | Ignatiev |
| 2014/0352343 | A1 | 12/2014 | Hinde et al. |
| 2015/0219379 | A1 | 8/2015 | Sun et al. |
| 2015/0300713 | A1 | 10/2015 | Sun et al. |
| 2016/0047578 | A1 | 2/2016 | Warren |
| 2016/0102901 | A1 | 4/2016 | Christensen et al. |
| 2016/0231040 | A1 | 8/2016 | Hellmann |
| 2016/0298883 | A1 | 10/2016 | Louvar et al. |
| 2017/0159977 | A1 | 6/2017 | Hellmann |
| 2017/0321941 | A1 | 11/2017 | Fredslund et al. |
| 2017/0328604 | A1 | 11/2017 | Fredslund et al. |
| 2018/0142927 | A1 | 5/2018 | Hellmann et al. |
| 2018/0164004 | A1 | 6/2018 | Schmidt et al. |
| 2018/0216851 | A1 | 8/2018 | Christensen et al. |
| 2018/0283750 | A1 | 10/2018 | Prins et al. |
| 2018/0320944 | A1 | 11/2018 | Prins et al. |
| 2019/0376728 | A1 | 12/2019 | Hayes et al. |

FOREIGN PATENT DOCUMENTS

| | | | | |
|---|---|---|---|---|
| CN | 101688697 | A | 3/2010 | |
| CN | 101809378 | A | 8/2010 | |
| CN | 103717981 | A | 4/2014 | |
| CN | 107076475 | A | 8/2017 | |
| CN | 108139132 | B | 6/2018 | |
| DE | 102006050232 | B3 | 2/2008 | |
| EP | 3023712 | A1 | 5/2016 | |
| EP | 3023714 | A1 | 5/2016 | |
| EP | 3371523 | A1 | 9/2018 | |
| EP | 2999932 | B1 | 7/2019 | |
| EP | 3581860 | A1 | 12/2019 | |
| EP | 3798533 | A1 | 3/2021 | |
| FR | 2992913 | A1 | 1/2014 | |
| WO | 2006015629 | A1 | 2/2006 | |
| WO | 2006015741 | A1 | 2/2006 | |
| WO | 2008130357 | A1 | 10/2008 | |
| WO | 2008130359 | A1 | 10/2008 | |
| WO | 2009039873 | A1 | 4/2009 | |
| WO | 2009041959 | A1 | 4/2009 | |
| WO | 2009091397 | A1 | 7/2009 | |
| WO | 2009091398 | A1 | 7/2009 | |
| WO | 2009091400 | A1 | 7/2009 | |
| WO | 2010039682 | A2 | 4/2010 | |
| WO | 2011049767 | A2 | 4/2011 | |
| WO | 2011049778 | A1 | 4/2011 | |
| WO | 2011112495 | A2 | 9/2011 | |
| WO | 2012076049 | A1 | 6/2012 | |
| WO | 2012109057 | A2 | 8/2012 | |
| WO | 2013016403 | A1 | 1/2013 | |
| WO | 2013169591 | A1 | 11/2013 | |
| WO | 2014031559 | A1 | 2/2014 | |
| WO | 2014179442 | A1 | 11/2014 | |
| WO | 2017067858 | A1 | 4/2017 | |
| WO | 2017076798 | A1 | 5/2017 | |
| WO | 2017220702 | A1 | 12/2017 | |
| WO | WO-2018095787 | A1 * | 5/2018 | ..... F25B 1/10 |

OTHER PUBLICATIONS

International Search Report for PCT Serial No. PCT/EP2019/074500 dated Nov. 25, 2019.
International Search Report for PCT Serial No. PCT/EP2015/073155 dated Jan. 20, 2016.
First Examination Report for Indian Serial No. 201717021000 dated Aug. 30, 2019.
First Examination Report for Indian Serial No. 202017056337 dated Jan. 6, 2022.

* cited by examiner

METHOD FOR CONTROLLING A VAPOUR COMPRESSION SYSTEM AT A REDUCED SUCTION PRESSURE

CROSS-REFERENCE TO RELATED APPLICATIONS

This application is a National Stage application of International Patent Application No. PCT/EP2019/074352, filed on Sep. 12, 2019, which claims priority to European Application No. 18196411.5 filed on Sep. 25, 2018, each of which is hereby incorporated by reference in its entirety.

TECHNICAL FIELD

The present invention relates to a method for controlling a vapour compression system comprising a compressor unit, a heat rejecting heat exchanger, a receiver, an expansion device and an evaporator arranged in a refrigerant path. The method according to the invention allows the vapour compression system to operate properly, even when the pressure prevailing inside the receiver is low.

BACKGROUND

In vapour compression systems refrigerant circulates a refrigerant path having at least a compressor, a heat rejecting heat exchanger, an expansion device and an evaporator arranged therein. Thereby the refrigerant is alternatingly compressed in the compressor and expanded in the expansion device, and heat exchange takes place between the refrigerant and appropriate secondary fluid flows or the ambient in the heat rejecting heat exchanger and the evaporator. Thereby cooling or heating of a closed volume can be obtained.

In some vapour compression systems a receiver is arranged in the refrigerant path between an outlet of the heat rejecting heat exchanger and an inlet of the expansion device. In this case the refrigerant is separated into a liquid part and a gaseous part in the receiver, and the liquid part of the refrigerant is supplied to the evaporator, via the expansion device. The gaseous part of the refrigerant may be supplied to a compressor. In order to operate such a vapour compression system in an appropriate manner, it is necessary to maintain a pressure level inside the receiver, which is appropriate under the prevailing operating conditions. For instance, when the outdoor temperature is low, such as during winter time, the temperature of refrigerant leaving the heat rejecting heat exchanger is also low. This results in a low pressure inside the receiver.

When the pressure prevailing inside the receiver is very low, the vapour compression system may not be able to operate properly. For instance, no or an insufficient flow of refrigerant may be supplied to the evaporator, and thereby the heat exchange taking place there will be insufficient, or even non-existent. A very low receiver pressure may even result in a situation where compressors are unable to start, and the vapour compression system will therefore stop operating.

In order to avoid the situations described above, various measures may be taken in order to control the pressure prevailing inside the receiver to be within a desired range. However, these measures may be insufficient.

WO 2017/067858 A1 discloses a method for controlling a vapour compression system in which a pressure prevailing inside a receiver is controlled in accordance with opening degrees of one or more expansion devices, each being arranged to control a supply of refrigerant to an evaporator.

SUMMARY

It is an object of embodiments of the invention to provide a method for controlling a vapour compression system which allows the vapour compression system to be operated properly, even when the pressure prevailing inside the receiver is low.

The invention provides a method for controlling a vapour compression system comprising a compressor unit comprising one or more compressors, a heat rejecting heat exchanger, a receiver, an expansion device and an evaporator arranged in a refrigerant path, the expansion device being arranged to control a supply of refrigerant to the evaporator, the method comprising the steps of:

- obtaining a pressure value indicating a pressure prevailing inside the receiver,
- comparing the obtained pressure value to a first threshold pressure value, and
- in the case that the obtained pressure value is below the first threshold pressure value, controlling the compressor(s) of the compressor unit in order to reduce a suction pressure of the vapour compression system.

Thus, the method according to the invention is for controlling a vapour compression system. In the present context the term 'vapour compression system' should be interpreted to mean any system in which a flow of fluid medium, such as refrigerant, circulates and is alternatingly compressed and expanded, thereby providing either refrigeration or heating of a volume. Thus, the vapour compression system may be a refrigeration system, an air condition system, a heat pump, etc.

The vapour compression system comprises a compressor unit comprising one or more compressors, a heat rejecting heat exchanger, a receiver, an expansion device and an evaporator arranged in a refrigerant path. The expansion device is arranged to control a supply of refrigerant to the evaporator. The heat rejecting heat exchanger could, e.g., be in the form of a condenser, in which refrigerant is at least partly condensed, or in the form of a gas cooler, in which refrigerant is cooled, but remains in a gaseous or trans-critical state. The expansion device could, e.g., be in the form of an expansion valve.

Thus, refrigerant flowing in the refrigerant path is compressed by the compressor(s) of the compressor unit. The compressed refrigerant is supplied to the heat rejecting heat exchanger, where heat exchange takes place with the ambient, or with a secondary fluid flow across the heat rejecting heat exchanger, in such a manner that heat is rejected from the refrigerant flowing through the heat rejecting heat exchanger. In the case that the heat rejecting heat exchanger is in the form of a condenser, the refrigerant is at least partly condensed when passing through the heat rejecting heat exchanger. In the case that the heat rejecting heat exchanger is in the form of a gas cooler, the refrigerant flowing through the heat rejecting heat exchanger is cooled, but it remains in a gaseous or trans-critical state.

From the heat rejecting heat exchanger, the refrigerant is supplied to the receiver, possibly via a high pressure expansion device, such as a high pressure valve or an ejector. In the receiver, the refrigerant is separated into a liquid part and a gaseous part. The liquid part of the refrigerant is supplied to the expansion device, where expansion takes place and the pressure of the refrigerant is reduced, before the refrigerant is supplied to the evaporator. The refrigerant being supplied to the evaporator is thereby in a mixed gaseous and liquid state. In the evaporator, the liquid part of the refrigerant is at least partly evaporated, while heat exchange takes place with the ambient, or with a secondary fluid flow across the evaporator, in such a manner that heat is absorbed by the refrigerant flowing through the evaporator. Finally, the refrigerant is supplied to the compressor unit.

The gaseous part of the refrigerant in the receiver may be supplied to the compressor unit. Thereby the gaseous part of the refrigerant is not subjected to the pressure drop introduced by the expansion device, and the work required in order to compress the refrigerant can thereby be reduced. Accordingly, energy is conserved.

According to the method of the invention, a pressure value indicating a pressure prevailing inside the receiver is initially obtained. This could include a direct measurement of the pressure prevailing inside the receiver. As an alternative, the pressure value could be derived from measurements of other parameters, such as measurements of pressure prevailing in other parts of the vapour compression system and/or measurements of temperature prevailing inside the receiver and/or in other parts of the vapour compression system. In any event, the obtained pressure value provides information regarding the current pressure inside the receiver.

Next, the obtained pressure value is compared to a first threshold pressure value. The first threshold pressure value may represent a pressure level inside the receiver, below which there is a risk that the vapour compression system will operate in an inefficient or inappropriate manner. The first threshold pressure value may be a fixed value, representing a pressure value below which the pressure prevailing inside the receiver should not be allowed to be. Alternatively, the first threshold pressure value may be a dynamical value which can be varied according to the prevailing ambient conditions, such as the outdoor temperature. This will be described in further detail below.

In the case that the comparison reveals that the obtained pressure value is below the first threshold pressure value, this is an indication that the pressure prevailing inside the receiver is approaching a level where there is a risk that the vapour compression system is no longer able to operate in an efficient or appropriate manner. Furthermore, this is an indication that the measures which are normally applied in order to maintain a sufficient pressure level inside the receiver are not sufficient. Therefore, when this situation occurs, the compressor(s) of the compressor unit are controlled in order to reduce a suction pressure of the vapour compression system.

In the present context the term 'suction pressure' should be interpreted to mean a pressure of refrigerant entering the compressor unit via the part of the refrigerant path which is connected to an outlet of the evaporator.

When the suction pressure is reduced in this manner, the compressor(s) of the compressor unit will remove more refrigerant from the evaporator, because the pressure difference across the expansion device is increased. This will increase the flow of refrigerant through the evaporator, and thereby the vapour compression system will continue to operate in an appropriate manner, despite the low pressure inside the receiver.

The step of controlling the compressor(s) of the compressor unit may comprise the steps of:

reducing a suction pressure setpoint value from an initial suction pressure setpoint value, $P_{0,set}$, to a reduced suction pressure setpoint value, $P_{0,red}$, and controlling the compressor(s) of the compressor unit based on the reduced suction pressure setpoint value, $P_{0,red}$.

According to this embodiment, the compressors of the compressor unit are controlled based on a setpoint value representing a desired suction pressure. This setpoint value may be a fixed value, or it may be variable in accordance with various operating conditions, e.g. according to the pressure prevailing inside the receiver. When a reduction of the suction pressure is required, as described above, the suction pressure setpoint value is lowered from an initial suction pressure setpoint value, $P_{0,set}$, to a reduced suction pressure setpoint value, $P_{0,red}$. The initial suction pressure setpoint value, $P_{0,set}$, represents a suction pressure which is appropriate and desirable under the prevailing operating conditions, i.e. it represents the suction pressure at which the vapour compression system would normally operate, under the given circumstances. The reduced suction pressure setpoint value, $P_{0,red}$, is a suction pressure value which is lower than the initial suction pressure setpoint value, $P_{0,set}$, i.e. it is reduced as compared to this value. The reduced suction pressure setpoint value, $P_{0,red}$, could, e.g., be a fixed amount lower than the initial suction pressure setpoint value, $P_{0,set}$, which could be a variable according to the operating conditions as described above.

The compressor(s) of the compressor unit are then controlled based on the reduced suction pressure setpoint value, $P_{0,red}$, i.e. the compressor(s) are controlled in order to achieve this reduced suction pressure. This will decrease the actual suction pressure from a level corresponding to the initial suction pressure setpoint value, $P_{0,set}$, to a level corresponding to the reduced suction pressure setpoint value, $P_{0,red}$, and thereby a reduction in suction pressure is obtained.

As an alternative, the suction pressure may be reduced in other ways, without changing a setpoint value. For instance, the step of reducing the suction pressure may comprise increasing the compressor capacity of the compressor unit. Such an increase in compressor capacity will also result in a reduced suction pressure. This could, e.g., include overruling the normal control of the compressor unit and/or forcing an additional compressor of the compressor unit to start.

The method may further comprise the step of adjusting a secondary fluid flow across the heat rejecting heat exchanger, based on the obtained pressure value. The secondary fluid flow across the heat rejecting heat exchanger has an impact on the heat exchange taking place in the heat rejecting heat exchanger. An increase in the secondary fluid flow results in an increased heat transfer from the refrigerant to the secondary fluid, and a decrease in the secondary fluid flow results in a decreased heat transfer from the refrigerant to the secondary fluid flow. Thus, an adjustment of the secondary fluid flow results in an adjustment in the temperature and pressure of the refrigerant leaving the heat rejecting heat exchanger, and this has an impact on the liquid-vapour ratio of the refrigerant being supplied to the receiver. This, in turn, affects the pressure prevailing inside the receiver. Accordingly, the pressure prevailing inside the receiver can be adjusted by appropriately adjusting the secondary fluid flow across the heat rejecting heat exchanger. Thus, adjusting the secondary fluid flow across the heat rejecting heat exchanger is one of the measures which may be taken in order to maintain the pressure prevailing inside the receiver at an appropriate level.

In the case that the secondary fluid flow across the heat rejecting heat exchanger is an air flow, the secondary fluid flow may be adjusted by adjusting a fan speed of one or more fans driving the secondary fluid flow and/or by switching one or more fans on or off. Alternatively, in the case that the secondary fluid flow is a liquid flow, the secondary fluid flow may be adjusted by adjusting one or more pumps driving the secondary fluid flow.

The compressor unit may comprise at least one main compressor being fluidly connected to an outlet of the evaporator and at least one receiver compressor being fluidly connected to a gaseous outlet of the receiver, and the method may further comprise the step of controlling the at least one receiver compressor based on the obtained pressure value.

According to this embodiment, refrigerant leaving the evaporator is supplied to the at least one main compressor, and refrigerant from the gaseous outlet of the receiver is supplied to the at least one receiver compressor. Thus, the receiver compressor removes gaseous refrigerant from the receiver and supplies compressed refrigerant to the heat rejecting heat exchanger. Thus, operating the receiver compressor reduces the pressure prevailing inside the receiver.

Each of the compressors of the compressor unit may be permanently connected to the outlet of the evaporator or to the gaseous outlet of the receiver. Alternatively, at least some of the compressors may be provided with a valve arrangement allowing the compressor to be selectively connected to the outlet of the evaporator or to the gaseous outlet of the receiver. In this case the available compressor capacity can be distributed in a suitable manner between 'main compressor capacity' and 'receiver compressor capacity', by appropriately operating the valve arrangement(s).

The supply of refrigerant to the receiver compressor(s) could, e.g., be adjusted by switching one or more compressors between being connected to the outlet of the evaporator and being connected to the gaseous outlet of the receiver. As an alternative, the compressor speed of one or more receiver compressors could be adjusted. As another alternative, one or more receiver compressors could be switched on or off. Finally, the supply of refrigerant to the receiver compressor(s) could be adjusted by controlling a bypass valve arranged in a part of the refrigerant path interconnecting the gaseous outlet of the receiver and the main compressor(s).

The step of obtaining a pressure value may comprise measuring the pressure prevailing inside the receiver. According to this embodiment, the pressure prevailing inside the receiver is directly measured, e.g. by means of a pressure sensor arranged inside the receiver. As an alternative, the pressure prevailing inside the receiver may be obtained in an indirect manner, e.g. by deriving the pressure from one or more other measured parameters, such as pressures prevailing in other parts of the vapour compression system and/or temperatures prevailing inside the receiver and/or in other parts of the vapour compression system.

The obtained pressure value may be low pass filtered before being compared to the first threshold pressure value, in order to remove short term fluctuations in the signal.

The step of controlling the compressor(s) of the compressor unit may comprise adjusting a compressor capacity of the compressor unit. The compressor capacity of the compressor unit affects how much refrigerant is removed from the suction line. Accordingly, adjusting the compressor capacity of the compressor unit has an impact on the suction pressure. More particularly, and increase in the compressor capacity results in more refrigerant being removed from the suction line. Thus, the suction pressure is decreased in this case. Similarly, a decrease in the compressor capacity results in less refrigerant being removed from the suction line, and an increase in the suction pressure.

The step of adjusting a compressor capacity of the compressor unit may comprise switching one or more compressors on or off. Switching on a compressor which was previously switched off increases the total compressor capacity by an amount corresponding to the compressor capacity of the compressor being switched on. Similarly, switching off a compressor which was previously switched on decreases the total compressor capacity by an amount corresponding to the compressor capacity of the compressor being switched off. Thus, according to this embodiment, the compressor capacity is adjusted in discrete steps corresponding to the capacities of the available compressors.

Alternatively or additionally, at least one of the compressors of the compressor unit may be a variable capacity compressor. In this case the step of adjusting a compressor capacity of the compressor unit may comprise varying the compressor capacity of one or more variable capacity compressors, e.g. by varying the speed of one or more compressors.

The method may further comprise the steps of:

after controlling the compressor(s) of the compressor unit in order to reduce the suction pressure of the vapour compression system, monitoring the pressure prevailing inside the receiver, comparing the monitored pressure prevailing inside the receiver to a second threshold pressure value, and in the case that the monitored pressure prevailing inside the receiver is above the second threshold pressure value, controlling the compressor(s) of the compressor unit in order to increase the suction pressure.

According to this embodiment, when it has been decided to reduce the suction pressure in the manner described above, the pressure prevailing inside the receiver is monitored, e.g. continuously, in order to establish whether or not the low pressure which gave rise to the reduction in suction pressure remains.

Accordingly, the monitored pressure prevailing inside the receiver is compared to a second threshold pressure value, and in the case that the monitored pressure is above the second threshold pressure value, the compressor(s) of the compressor unit is/are controlled in order to increase the suction pressure.

The second threshold pressure value may be identical to the first threshold pressure value, in which case the suction pressure will be increased as soon as the pressure prevailing inside the receiver has increased to a level above the first threshold pressure value. However, in most cases the second threshold pressure value is higher than the first threshold pressure value in order to avoid repeatedly switching between reducing and increasing the suction pressure in the case that the pressure prevailing inside the receiver is approximately equal to the first threshold pressure value.

Thus, according to this embodiment, a reduced suction pressure is only maintained as long as the pressure prevailing inside the receiver is so low that there is a risk that the vapour compression system may not operate in an appropriate manner. As soon as the pressure prevailing inside the receiver has reached a level where this is no longer the case, the suction pressure is once again allowed to increase. This is an advantage because maintaining a low suction pressure requires additional energy consumption, because the compressors of the compressor unit need to work harder. By allowing the suction pressure to increase when the low suction pressure is no longer required, energy is therefore conserved.

The step of controlling the compressor(s) of the compressor unit in order to increase the suction pressure may comprise increasing a suction pressure setpoint value, e.g. from a reduced suction pressure setpoint value, $P_{0,red}$, to an initial suction pressure setpoint value, $P_{0,set}$, i.e. the initial suction pressure setpoint value, $P_{0,set}$, may be restored. This is similar to reducing the suction pressure by reducing the suction pressure setpoint value described above, and the remarks set forth in this regard are therefore equally applicable here.

The vapour compression system may further comprise a high pressure expansion device arranged fluidly between an outlet of the heat rejecting heat exchanger and an inlet of the receiver. In this case the refrigerant leaving the heat rejecting heat exchanger undergoes expansion before being supplied to the receiver.

The high pressure expansion device may be in the form of a high pressure valve, in which case the refrigerant is merely expanded when passing through the high pressure valve.

As an alternative, the high pressure expansion device may be in the form of an ejector having a primary inlet connected to the outlet of the heat rejecting heat exchanger, an outlet connected to the receiver and a secondary inlet connected to the outlet of the evaporator. Thereby at least some of the refrigerant leaving the evaporator is supplied to the secondary inlet of the ejector. An ejector is a type of pump which uses the Venturi effect to increase the pressure energy of fluid at a suction inlet (or secondary inlet) of the ejector by means of a motive fluid supplied to a motive inlet (or primary inlet) of the ejector. Thereby, arranging an ejector in the refrigerant path as described above will cause the refrigerant to perform work, and thereby the power consumption of the vapour compression system is reduced as compared to the situation where no ejector is provided.

As another alternative, the high pressure expansion device may comprise at least one high pressure valve and at least one ejector arranged fluidly in parallel.

In the case that the vapour compression system comprises a high pressure expansion device as described above, a pressure prevailing in the heat rejecting heat exchanger may be controlled by controlling a fluid flow through the high pressure expansion device. This could, e.g., include controlling an opening degree of the high pressure expansion device.

The method may further comprise the step of dynamically determining the first threshold pressure value. According to this embodiment, the first threshold pressure value is not a fixed value, but rather a value which may vary according to the prevailing ambient conditions, such as the outdoor temperature, etc. Thereby it is ensured that such ambient conditions are taken into account when deciding whether or not to operate the vapour compression system at a reduced suction pressure.

The step of dynamically determining the first threshold pressure value may comprise determining the first threshold value based on a varying initial suction pressure setpoint value, $P_{0,set}$. According to this embodiment, the suction pressure setpoint value, $P_{0,set}$, varies, e.g. in accordance with prevailing ambient conditions. By determining the first threshold value based on such a varying suction pressure setpoint value, it is ensured that a suitable pressure difference between the pressure prevailing inside the receiver and the suction pressure setpoint value is always maintained. Since the suction pressure is controlled in accordance with the suction pressure setpoint value, it is thereby also ensured that a suitable pressure difference across the evaporator is always maintained, regardless of the ambient conditions.

Accordingly, an appropriate first threshold value can be selected, which ensures a desired pressure difference across the expansion device, and thereby ensures appropriate operation of the vapour compression system. For instance, if the suction pressure is low, a low pressure inside the receiver may be acceptable, because a sufficient pressure difference across the expansion device is still ensured. In this case a low first threshold pressure value may be selected. Similarly, if the suction pressure is high, a high pressure inside the receiver is also required in order to ensure a sufficient pressure difference across the expansion device. In this case a high first threshold value may therefore be selected.

For instance, the step of dynamically determining the first threshold pressure value may comprise adding a predefined pressure difference, $\Delta P$, to the initial suction pressure setpoint value, $P_{0,set}$, and applying the result as the first threshold pressure value, $P_{thres}=P_{0,set}+\Delta P$. Thereby it is efficiently ensured that a pressure difference across the expansion device, which is equal to or higher than $\Delta P$, is always present, regardless of the absolute pressure values in the suction line and the receiver, respectively. Thus, $\Delta P$ may advantageously correspond to a minimum acceptable pressure difference across the expansion device.

BRIEF DESCRIPTION OF THE DRAWINGS

The invention will now be described in further detail with reference to the accompanying drawings in which.

DETAILED DESCRIPTION

Figure 1:
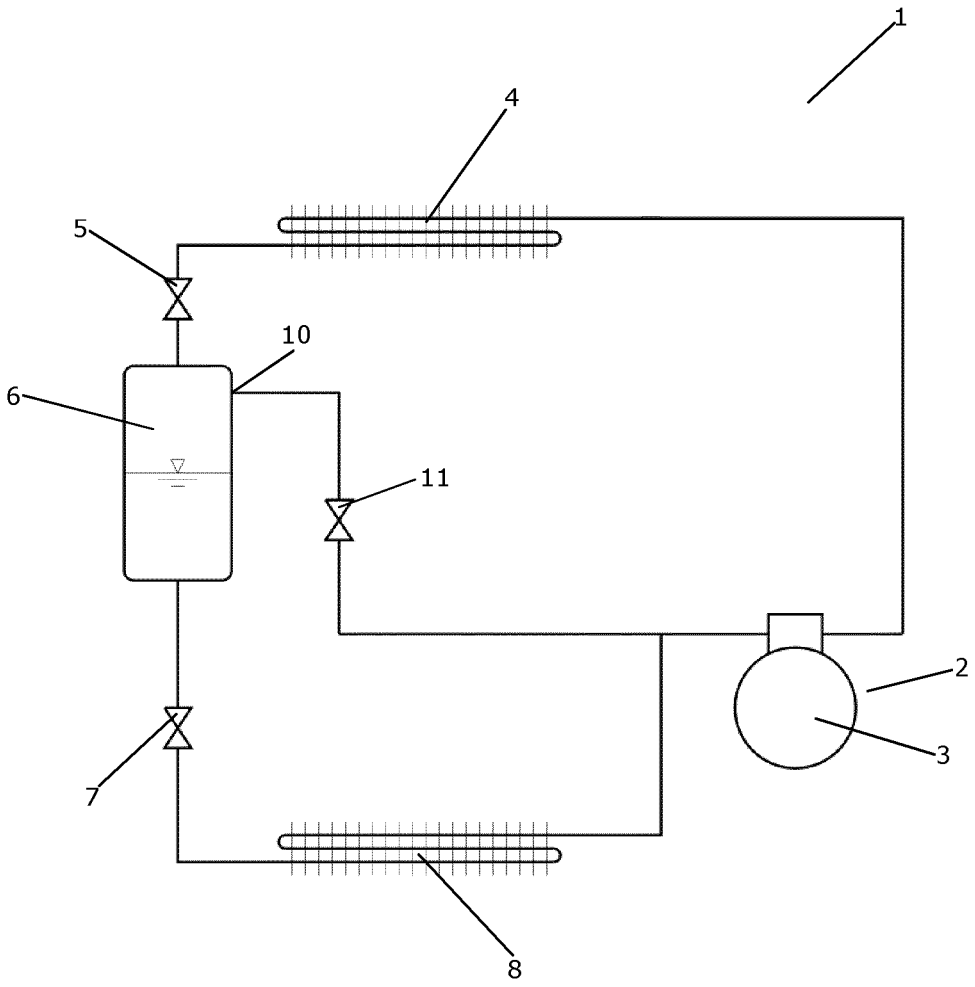
FIGS. 1-4 are diagrammatic views of four different vapour compression systems, each being controlled in accordance with a method according to an embodiment of the invention.

FIG. 1 is a diagrammatic view of a vapour compression system 1 being controlled in accordance with a method according to a first embodiment of the invention. The vapour compression system 1 comprises a compressor unit 2 comprising one or more compressors 3, one of which is shown, a heat rejecting heat exchanger 4, a high pressure valve 5, a receiver 6, an expansion valve 7 and an evaporator 8 arranged in a refrigerant path.

Refrigerant flowing in the refrigerant path is compressed by the compressor 3 before being supplied to the heat rejecting heat exchanger 4. In the heat rejecting heat exchanger 4, heat exchange takes place between the refrigerant flowing through the heat rejecting heat exchanger 4 and the ambient or a secondary fluid flow across the heat rejecting heat exchanger 4, in such a manner that heat is rejected from the refrigerant. In the case that the heat rejecting heat exchanger 4 is in the form of a condenser, the refrigerant is thereby at least partly condensed. In the case that the heat rejecting heat exchanger 4 is in the form of a gas cooler, the refrigerant flowing through the heat rejecting heat exchanger 4 is cooled, but it remains in a gaseous or trans-critical state.

The refrigerant leaving the heat rejecting heat exchanger 4 is passed through the high pressure valve 5, where it undergoes expansion before being supplied to the receiver 6. In the receiver 6, the refrigerant is separated into a liquid part and a gaseous part. The liquid part of the refrigerant leaves the receiver 6 via a liquid outlet 9, and is supplied to the expansion device 7, where it undergoes expansion before being supplied to the evaporator 8. The refrigerant being supplied to the evaporator 8 is thereby in a mixed gaseous and liquid state.

In the evaporator 8, heat exchange takes place between the refrigerant flowing through the evaporator 8 and the ambient or a secondary fluid flow across the evaporator 8, in such a manner that heat is absorbed by the refrigerant, while the liquid part of the refrigerant is at least partly evaporated. Finally, the refrigerant leaving the evaporator 8 is once again supplied to the compressor 3.

The gaseous part of the refrigerant in the receiver 6 may be supplied directly to the compressor 3, via a gaseous outlet 10 and a bypass valve 11.

The vapour compression system 1 may be controlled in the following manner. A pressure value indicating a pressure prevailing inside the receiver 6 is obtained, e.g. by directly measuring the pressure by means of a pressure sensor arranged inside the receiver 6. The obtained pressure value is then compared to a first threshold pressure value. The first threshold pressure value may represent a pressure level inside the receiver 6, below which there is a risk that the vapour compression system 1 may not operate in an appropriate manner, because a low pressure inside the receiver 6 may lead to an insufficient supply of refrigerant to the evaporator 8.

In the case that the comparison reveals that the obtained pressure value is below the first threshold pressure value, the compressor 3 is operated in order to reduce the suction pressure of the vapour compression system 1, i.e. the pressure of refrigerant being supplied to the compressor 3. This may, e.g., be obtained by increasing the compressor capacity of the compressor unit 2, e.g. by increasing a speed of the compressor 3, or by switching on an additional compressor 3. Alternatively, the suction pressure may be reduced by reducing a suction pressure setpoint value from an initial suction pressure setpoint value, $P_{0,set}$, to a reduced suction pressure setpoint value, $P_{0,red}$, and then control the compressor 3 based on the reduced suction pressure setpoint value, $P_{0,red}$.

In the case that it is subsequently revealed that the pressure prevailing inside the receiver 6 has increased to a level where there is no longer a risk that the vapour compression system 1 may not operate in an appropriate manner, the suction pressure may once again be increased. This may, e.g., be obtained by restoring the initial suction pressure setpoint value, $P_{0,set}$, and then control the compressor 3 based on the restored, initial suction pressure setpoint value, $P_{0,set}$.

Figure 2:
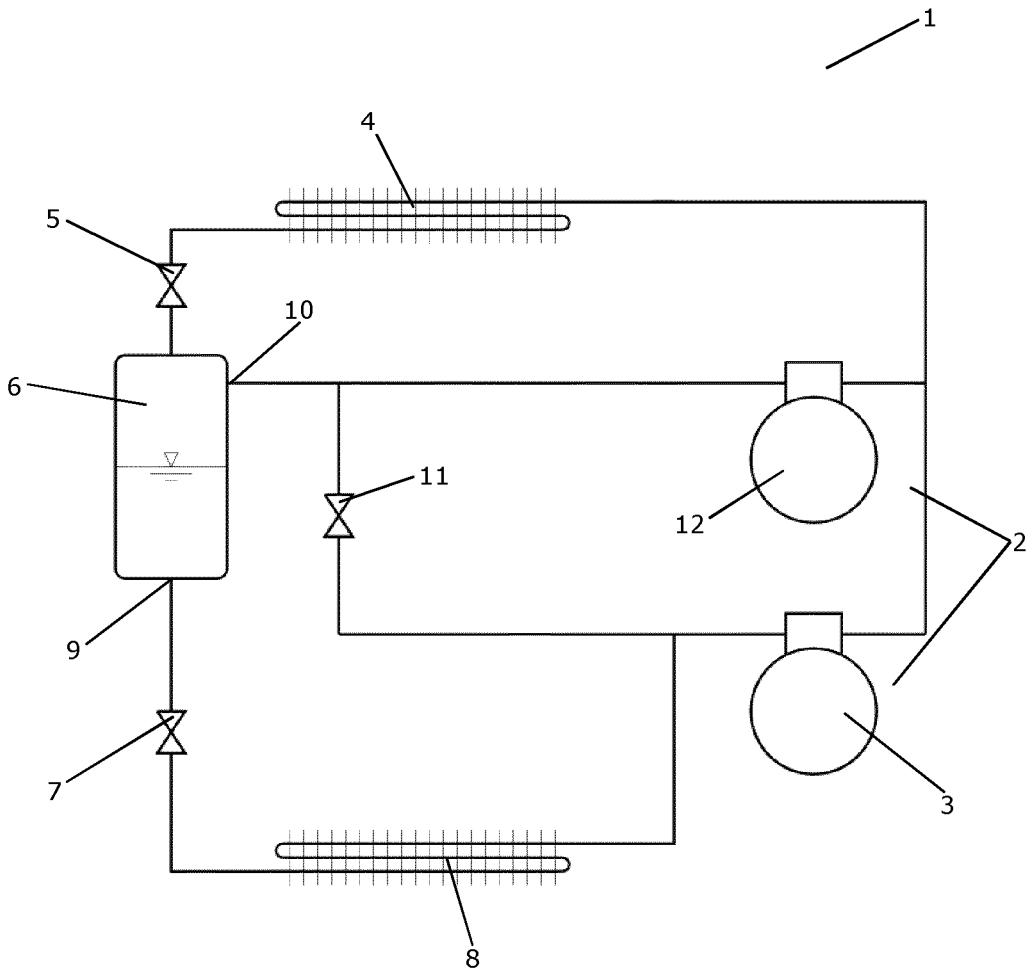

FIG. 2 is a diagrammatic view of a vapour compression system 1 being controlled in accordance with a method according to a second embodiment of the invention. The vapour compression system 1 of FIG. 2 is very similar to the vapour compression system 1 of FIG. 1, and it will therefore not be described in detail here.

In the vapour compression system 1 of FIG. 2 the compressor unit 2 further comprises a receiver compressor 12 connected to the gaseous outlet 10 of the receiver 6. Thereby gaseous refrigerant from the receiver 6 may be supplied directly to the receiver compressor 12, and may therefore be compressed without having to be mixed with refrigerant leaving the evaporator 8, and thereby without affecting the suction pressure of the vapour compression system 1.

The vapour compression system 1 of FIG. 2 may be controlled essentially as described above with reference to FIG. 1. Furthermore, the pressure prevailing inside the receiver 6 may be controlled by controlling the receiver compressor 12.

Figure 3:
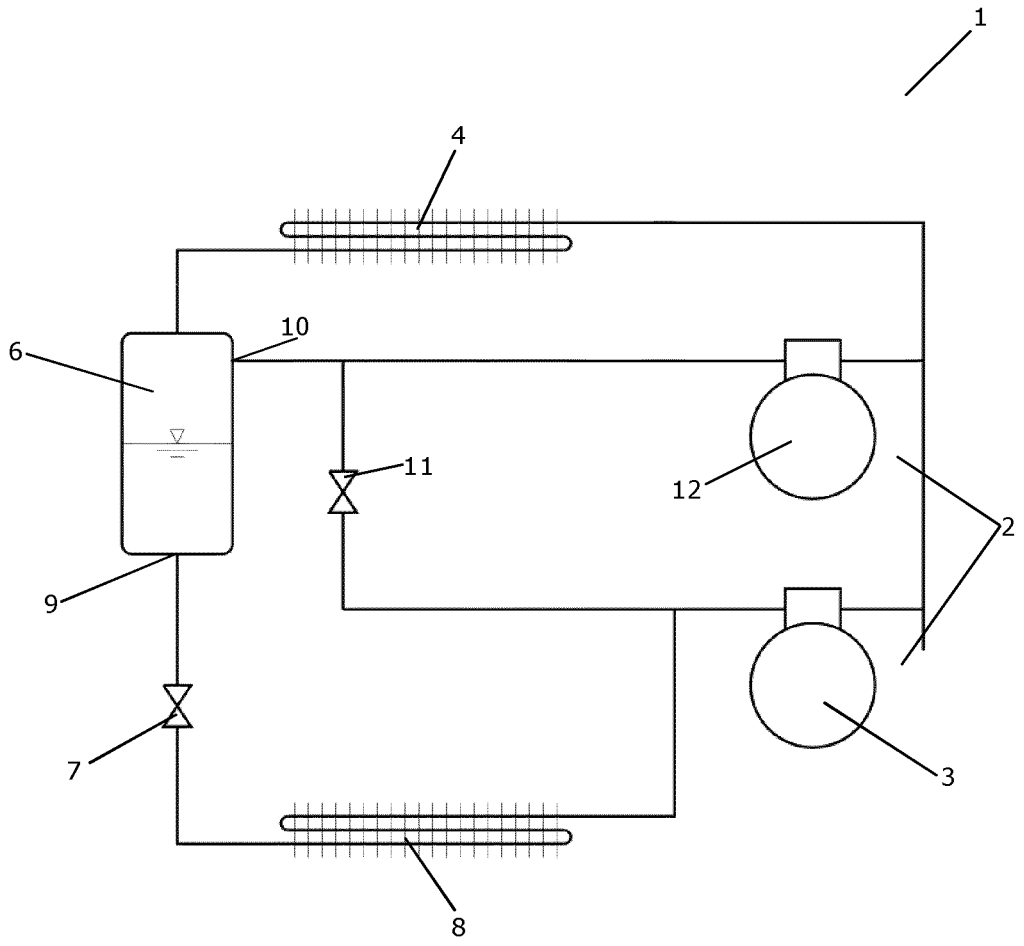

FIG. 3 is a diagrammatic view of a vapour compression system 1 being controlled in accordance with a method according to a third embodiment of the invention. The vapour compression system 1 of FIG. 3 is very similar to the vapour compression system 1 of FIG. 2, and it will therefore not be described in detail here.

The vapour compression system 1 of FIG. 3 is not provided with a high pressure valve. Accordingly, the refrigerant leaving the heat rejecting heat exchanger 4 is supplied directly to the receiver 6 without undergoing expansion. The vapour compression system 1 of FIG. 3 may be controlled essentially as described above with reference to FIG. 1.

Figure 4:
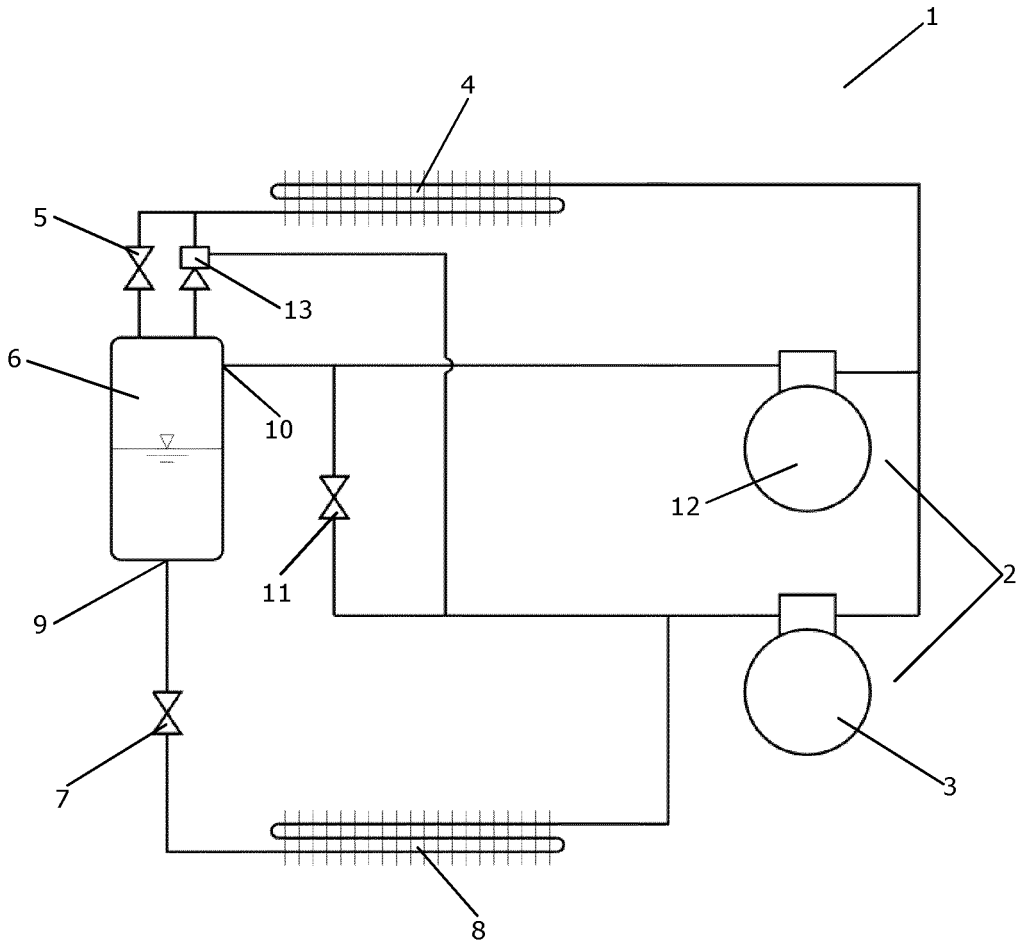

FIG. 4 is a diagrammatic view of a vapour compression system 1 being controlled in accordance with a method according to a fourth embodiment of the invention. The vapour compression system 1 of FIG. 4 is very similar to the vapour compression system 1 of FIG. 2, and it will therefore not be described in detail here.

In the vapour compression system 1 of FIG. 4, an ejector 13 is arranged fluidly in parallel with the high pressure valve 5. Accordingly, refrigerant leaving the heat rejecting heat exchanger 4 may pass through the high pressure valve 5 or through the ejector 13. The ejector 13 further has its secondary inlet connected to the outlet of the evaporator 8. Accordingly, refrigerant leaving the evaporator 8 may either be supplied to the compressor 3 or to the ejector 13. The vapour compression system 1 of FIG. 4 may be controlled essentially as described above with reference to FIG. 1.

Figure 5:
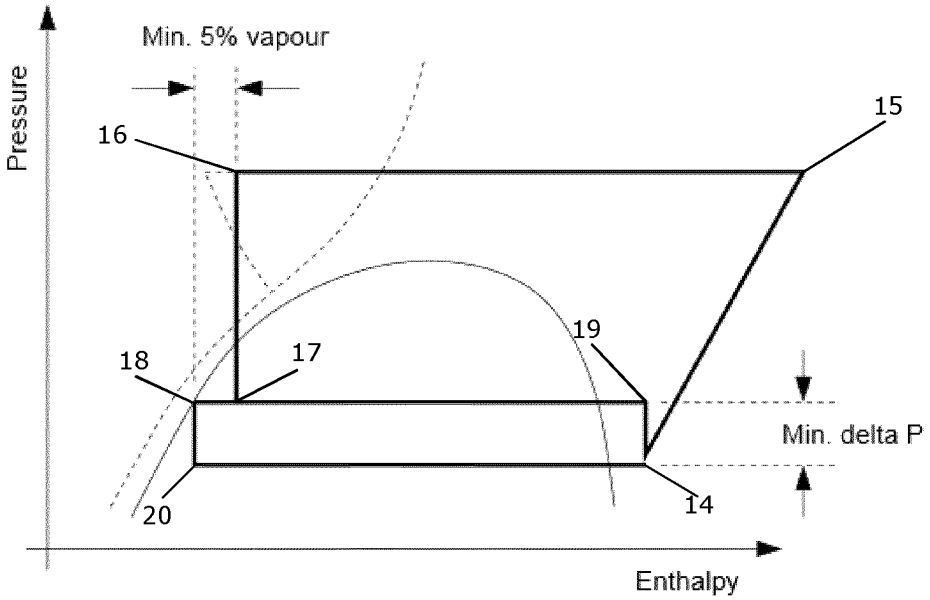
FIG. 5 is a log(P)-h diagram illustrating control of a vapour compression system in accordance with a method according to an embodiment of the invention.

FIG. 5 is a log(P)-h diagram illustrating control of a vapour compression system in accordance with a method according to an embodiment of the invention. The vapour compression system being controlled could, e.g., be one of the vapour compression systems illustrated in FIGS. 1-4. From point 14 to point 15 the refrigerant is compressed in the compressor unit. Thereby the pressure as well as the enthalpy is increased. From point 15 to point 16 the refrigerant passes through the heat rejecting heat exchanger, where heat exchange takes place between the refrigerant and the ambient or a secondary fluid flow across the heat rejecting heat exchanger, in such a manner that heat is rejected from the refrigerant. Thereby the enthalpy is decreased, while the pressure remains constant.

From point 16 to point 17 the refrigerant passes through a high pressure valve or an ejector, where the refrigerant undergoes expansion, and is received in the receiver. Thereby the pressure is decreased, while the enthalpy remains substantially constant.

In the receiver the refrigerant is separated into a liquid part and a gaseous part. Point 18 represents the liquid part of the refrigerant in the receiver, and point 19 represents the gaseous part of the refrigerant in the receiver. From point 18 to point 20 the liquid part of the refrigerant in the receiver is passed through the expansion device, where it undergoes expansion. Thereby the pressure is reduced while the enthalpy remains constant. From point 20 to point 14 the refrigerant passes through the evaporator, where heat exchange takes place between the refrigerant and the ambient or a secondary fluid flow across the evaporator, in such a manner that heat is absorbed by the refrigerant. Thereby the enthalpy is increased, while the pressure remains constant.

From point 19 to point 14 the gaseous part of the refrigerant in the receiver is supplied to the suction line via a bypass valve, and is thereby mixed with refrigerant leaving the evaporator. Passing the refrigerant through the bypass valve causes the pressure to decrease while the enthalpy remains constant.

The position of the point 17 corresponds to the enthalpy of the refrigerant which leaves the heat rejecting heat exchanger and is supplied to the receiver. This enthalpy determines the liquid-vapour ratio of the refrigerant entering the receiver, and the liquid-vapour ratio of the refrigerant entering the receiver has an impact on the pressure prevailing in the receiver. Thus, when the enthalpy of the refrigerant entering the receiver is low, corresponding to the point 17 being arranged far to the left, a large portion of the refrigerant entering the receiver is liquid. Similarly, when the enthalpy of the refrigerant entering the receiver is high, corresponding to the point 17 being arranged far to the right, a large portion of the refrigerant entering the receiver is gaseous, i.e. in the form of vapour.

Accordingly, the liquid-vapour ratio of the refrigerant in the receiver, and thereby the pressure prevailing inside the receiver, can be adjusted by adjusting the enthalpy of the refrigerant leaving the heat rejecting heat exchanger. This may be done by adjusting a secondary fluid flow across the heat rejecting heat exchanger, e.g. by adjusting a fan speed of one or more fans driving this flow. Adjusting the secondary fluid flow has an impact on the heat transfer taking place in the heat rejecting heat exchanger, and this in turn affects the enthalpy of the refrigerant leaving the heat rejecting heat exchanger.

Thus, adjusting a secondary fluid flow across the heat rejecting heat exchanger is one way of controlling the pressure prevailing inside the receiver. Preferably, the liquid-vapour ratio of the refrigerant entering the receiver should be such that at least 5% of the refrigerant is in the form of vapour.

Furthermore, in order to ensure a sufficient refrigerant supply to the evaporator, a certain minimum pressure difference between the pressure prevailing inside the receiver and the suction pressure, i.e. the pressure difference across the expansion device, must be maintained. This pressure difference is represented by the difference between the pressure at point 19, representing the pressure prevailing inside the receiver, and the pressure at point 14, representing the suction pressure.

In the case that this pressure difference becomes too small, it may initially be attempted to increase the pressure prevailing inside the receiver, e.g. in the manner described above. If this is not sufficient to maintain the minimum pressure difference, the suction pressure may be reduced instead, thereby shifting point 14 downwards, i.e. towards a lower pressure value. This could, e.g., be done in the manner described above with reference to FIG. 1.

While the present disclosure has been illustrated and described with respect to a particular embodiment thereof, it should be appreciated by those of ordinary skill in the art that various modifications to this disclosure may be made without departing from the spirit and scope of the present disclosure.

What is claimed is:

1. A method for controlling a vapour compression system comprising a compressor unit comprising one or more compressors, a heat rejecting heat exchanger, a receiver, an expansion device and an evaporator arranged in a refrigerant path, the expansion device being arranged to control a supply of refrigerant to the evaporator, the method comprising the steps of:

obtaining a pressure value indicating a pressure prevailing inside the receiver, comparing the obtained pressure value to a first threshold pressure value, and in the case that the obtained pressure value is below the first threshold pressure value, controlling the compressor(s) of the compressor unit in order to reduce a suction pressure of the vapour compression system;

wherein the step of controlling the compressor(s) of the compressor unit comprises adjusting a compressor capacity of the compressor unit; and wherein the step of adjusting a compressor capacity of the compressor unit comprises switching one or more compressors on or off.

2. The method according to claim 1, wherein the step of reducing the suction pressure comprises increasing the compressor capacity of the compressor unit.

3. The method according to claim 1, further comprising the step of adjusting a secondary fluid flow across the heat rejecting heat exchanger, based on the obtained pressure value.

4. The method according to claim 1, wherein the step of obtaining a pressure value comprises measuring the pressure prevailing inside the receiver.

5. The method according to claim 1, further comprising the steps of:

after controlling the compressor(s) of the compressor unit in order to reduce the suction pressure of the vapour compression system, monitoring the pressure prevailing inside the receiver, comparing the monitored pressure prevailing inside the receiver to a second threshold pressure value, and in the case that the monitored pressure prevailing inside the receiver is above the second threshold pressure value, controlling the compressor(s) of the compressor unit in order to increase the suction pressure.

6. The method according to claim 1, further comprising the step of dynamically determining the first threshold pressure value.

7. The method according to claim 6, wherein the step of dynamically determining the first threshold pressure value comprises determining the first threshold value based on a varying initial suction pressure setpoint value, $P_{0,set}$.

8. The method according to claim 7, wherein the step of dynamically determining the first threshold pressure value comprises adding a predefined pressure difference, $\Delta P$, to the initial suction pressure setpoint value, $P_{0,set}$, and applying the result as the first threshold pressure value, $P_{thres}=P_{0,set}+\Delta P$.

9. The method according to claim 2, further comprising the step of adjusting a secondary fluid flow across the heat rejecting heat exchanger, based on the obtained pressure value.

10. The method according to claim 2, wherein the compressor unit comprises at least one main compressor being fluidly connected to an outlet of the evaporator and at least one receiver compressor being fluidly connected to a gaseous outlet of the receiver, and wherein the method further comprises the step of controlling the at least one receiver compressor based on the obtained pressure value.

11. The method according to claim 3, wherein the compressor unit comprises at least one main compressor being fluidly connected to an outlet of the evaporator and at least one receiver compressor being fluidly connected to a gaseous outlet of the receiver, and wherein the method further comprises the step of controlling the at least one receiver compressor based on the obtained pressure value.

12. The method according to claim 2, wherein the step of obtaining a pressure value comprises measuring the pressure prevailing inside the receiver.

13. The method according to claim 3, wherein the step of obtaining a pressure value comprises measuring the pressure prevailing inside the receiver.

14. A method for controlling a vapour compression system comprising a compressor unit comprising one or more compressors, a heat rejecting heat exchanger, a receiver, an expansion device and an evaporator arranged in a refrigerant path, the expansion device being arranged to control a supply of refrigerant to the evaporator, the method comprising the steps of:

obtaining a pressure value indicating a pressure prevailing inside the receiver, comparing the obtained pressure value to a first threshold pressure value, and in the case that the obtained pressure value is below the first threshold pressure value, controlling the compressor(s) of the compressor unit in order to reduce a suction pressure of the vapour compression system;

wherein the step of controlling the compressor(s) of the compressor unit comprises the steps of:

reducing a suction pressure setpoint value from an initial suction pressure setpoint value, $P_{0,set}$, to a reduced suction pressure setpoint value, $P_{0,red}$, and controlling the compressor(s) of the compressor unit based on the reduced suction pressure setpoint value, $P_{0,red}$.

15. The method according to claim 14, further comprising the step of adjusting a secondary fluid flow across the heat rejecting heat exchanger, based on the obtained pressure value.

16. The method according to claim 14, wherein the compressor unit comprises at least one main compressor being fluidly connected to an outlet of the evaporator and at least one receiver compressor being fluidly connected to a gaseous outlet of the receiver, and wherein the method further comprises the step of controlling the at least one receiver compressor based on the obtained pressure value.

17. The method according to claim 14, wherein the step of obtaining a pressure value comprises measuring the pressure prevailing inside the receiver.

18. A method for controlling a vapour compression system comprising a compressor unit comprising one or more compressors, a heat rejecting heat exchanger, a receiver, an expansion device and an evaporator arranged in a refrigerant path, the expansion device being arranged to control a supply of refrigerant to the evaporator, the method comprising the steps of:

obtaining a pressure value indicating a pressure prevailing inside the receiver, comparing the obtained pressure value to a first threshold pressure value, and in the case that the obtained pressure value is below the first threshold pressure value, controlling the compressor(s) of the compressor unit in order to reduce a suction pressure of the vapour compression system;

wherein the compressor unit comprises at least one main compressor being fluidly connected to an outlet of the evaporator and at least one receiver compressor being fluidly connected to a gaseous outlet of the receiver, and wherein the method further comprises the step of controlling the at least one receiver compressor based on the obtained pressure value.

* * * * *